US006478623B1

(12) United States Patent
Wu

(10) Patent No.: US 6,478,623 B1
(45) Date of Patent: Nov. 12, 2002

(54) HEADER CONNECTOR WITH SHELL

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/015,034

(22) Filed: Dec. 11, 2001

(51) Int. Cl.[7] ..... H01R 13/648
(52) U.S. Cl. ..... 439/607
(58) Field of Search ..... 439/609, 607, 439/78, 571, 572, 573

(56) References Cited

U.S. PATENT DOCUMENTS 4,718,867 A * 1/1988 Siedel et al. ..... 439/609
4,946,400 A * 8/1990 Kawai et al. ..... 439/609
5,478,260 A * 12/1995 Kaufman et al. ..... 439/609
5,865,645 A * 2/1999 Embo et al. ..... 439/607
6,042,398 A * 3/2000 Wu et al. ..... 439/607
6,050,852 A * 4/2000 Wu ..... 439/607
6,056,560 A * 5/2000 Wu et al. ..... 439/607
6,080,016 A * 6/2000 Ho et al. ..... 439/607
6,155,876 A * 12/2000 Ho et al. ..... 439/607

* cited by examiner

*Primary Examiner*—Gary F. Paumen
(74) *Attorney, Agent, or Firm*—Wei Te Chung

(57) ABSTRACT

A header connector (1) comprises an insulative housing (2), a number of terminals (3) received in the housing and a shell (4) enclosing the housing for electromagnetic protection. The housing defines an aperture (2640), a number of recesses (260), a number of grooves (262) and a pair of holes (2680). The shell includes a number of spring arms (40) for being received in the recesses of the housing, a pair of extensions (46) having barbs (460) formed thereon for interferential engagement with the aperture of the housing, a number of tab members (42) for being received in the grooves of the housing and a pair of fingers (44) for being received in the holes of the housing. Thus, the shell completely encloses the housing.

1 Claim, 5 Drawing Sheets

HEADER CONNECTOR WITH SHELL

BACKGROUND OF THE INVENTION

1. Field of the Invention

The present invention relates to a header connector, and particularly to a header connector with a shell for EMI (Electromagnetic Interference) protection.

2. Description of Related Art

Almost every computer is equipped with a header connector for engaging with a cable end connector which connects with a hard disk drive to establish an electrical connection between the hard disk drive and a printed circuit board on which the header connector is mounted. A conventional header connector comprises an insulative housing defining a cavity and a plurality of passageways in communication with the cavity, and a plurality of pin-type terminals received in the passageways of the housing. Each terminal includes a mating portion disposed in the cavity for electrically engaging with a corresponding terminal of a complementary cable end connector, and a tail portion projecting beyond a mounting face of the housing for electrical connection with a printed circuit board. However, when it is required that the header connector carry out high speed data transmission between the printed circuit board and the hard disk drive, electromagnetic or radio frequency interference increases. As a result, the quality of signal transmission between the printed circuit board and the hard disk drive may be adversely affected. Hence, a header connector with a shell is desired to overcome the disadvantages of the related art.

SUMMARY OF THE INVENTION

Accordingly, one object of the present invention is to provide a header connector with a shell enclosing an insulative housing thereof for electromagnetic interference protection.

Another object of the present invention is to provide a shell for a header connector which can be conveniently and securely assembled to an insulative housing of the connector.

In order to achieve the objects set forth, a header connector with a shell in accordance with the present invention comprises a rectangular insulative housing, a plurality of terminals retained in the housing and a shell enclosing the housing. The housing comprises a receiving cavity defined through a mating face thereof, a plurality of grooves defined in a front and a rear walls thereof, a cutout defined in the front wall and communicating with the receiving cavity, a protrusion formed on the front wall and below the cutout, and a pair of embossments each having a hole defined therein formed on opposite side walls thereof. The protrusion defines an aperture therein. The shell is generally in a rectangular box-like form and comprises a body portion and a pair of opposite end portions each having a downward extension integrally extending therefrom. The extensions are inserted in the aperture and closely abut each other. The body portion includes a plurality of spring arms extending downwardly into the receiving cavity, a plurality of inwardly extending tab members received in the grooves of the housing and a pair of fingers received in the holes of the embossments of the housing. Thus, the shell completely encloses the housing for electromagnetic protection.

Other objects, advantages and novel features of the invention will become more apparent from the following detailed description when taken in conjunction with the accompanying drawings.

DETAILED DESCRIPTION OF THE INVENTION

Figure 1:
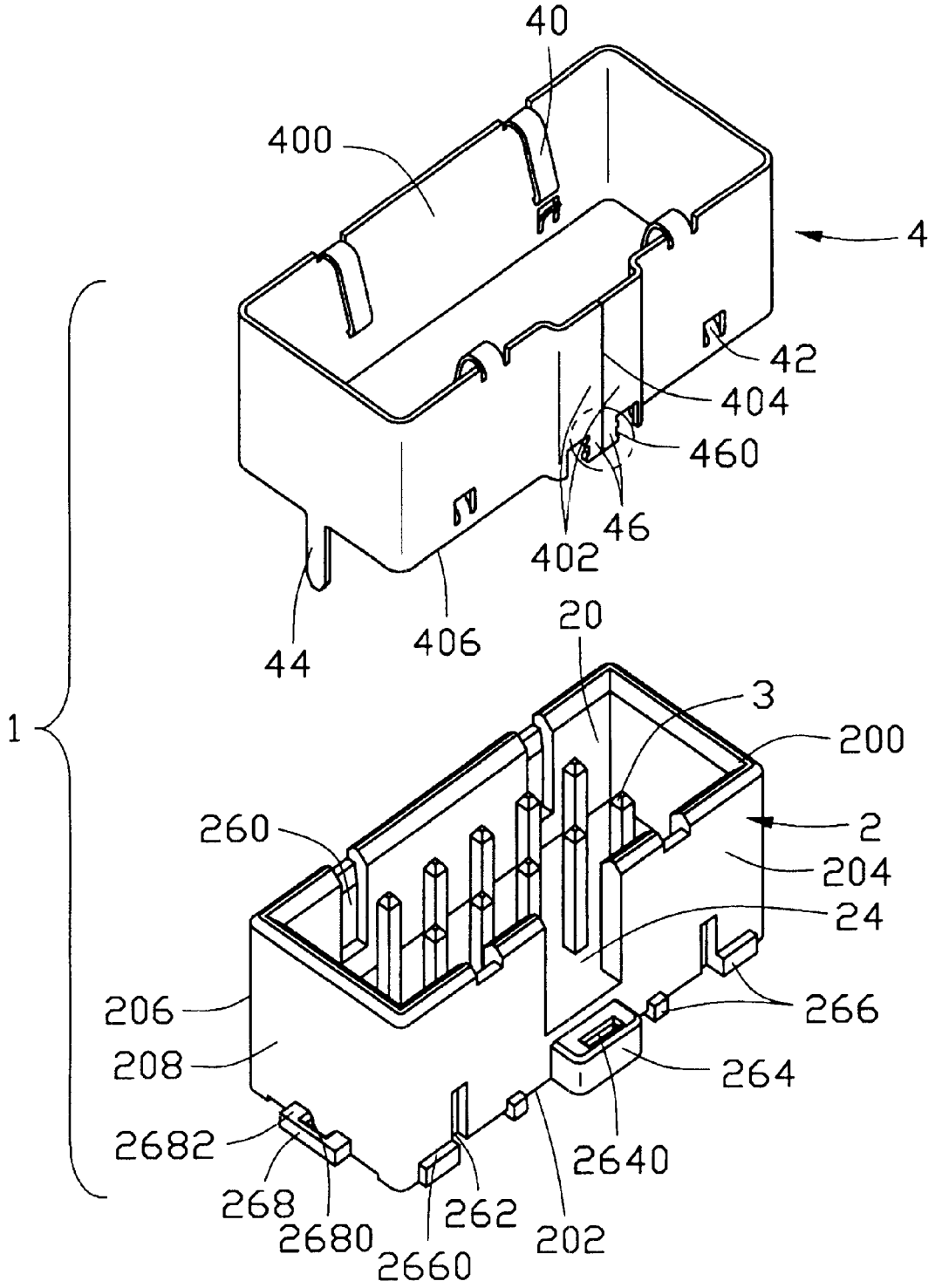
FIG. 1 is a partially exploded, perspective view of a header connector with a shell in accordance with the present invention.
Figure 2:
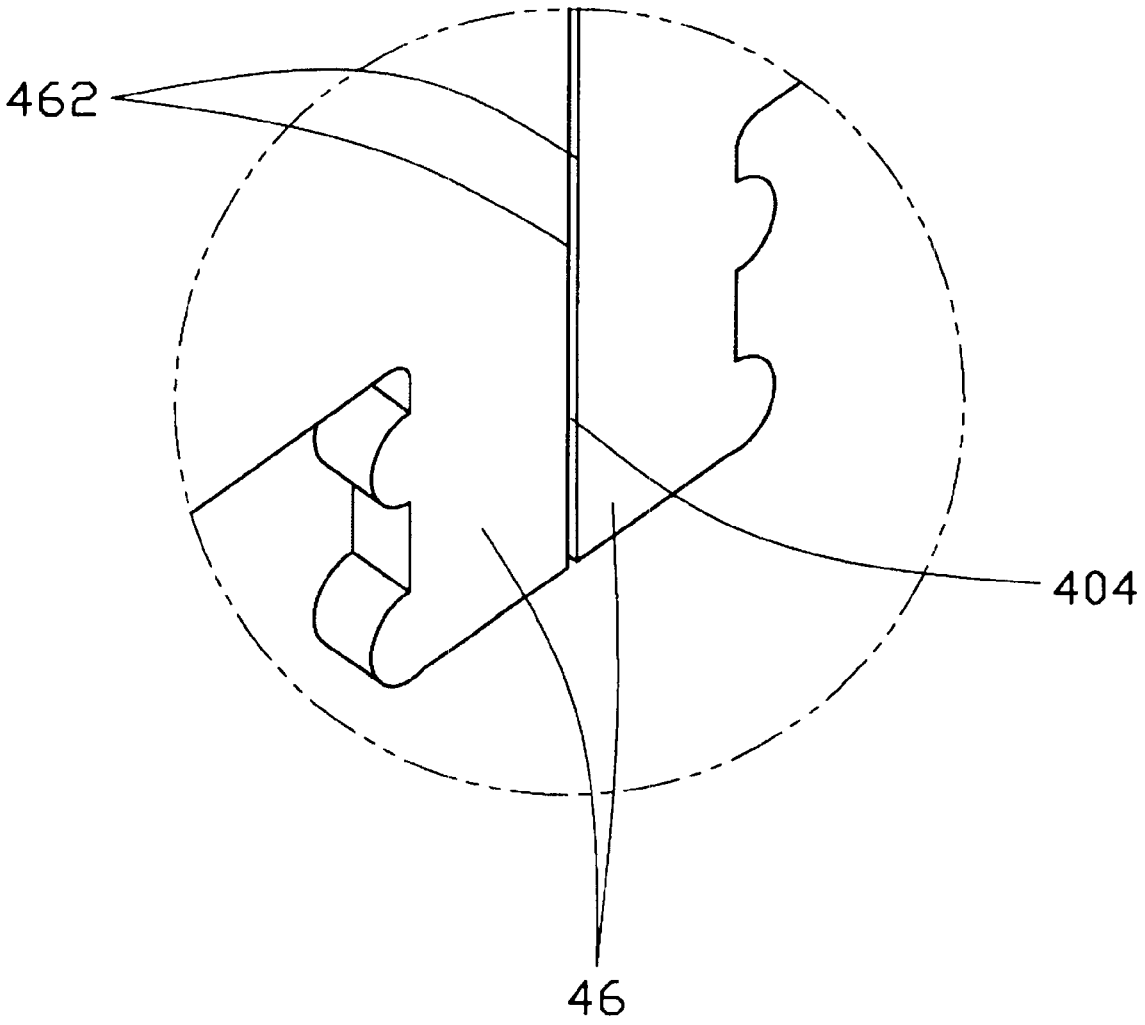
FIG. 2 is an enlarged view of a circled portion in FIG. 1 before the shell is assembled to an insulative housing of the connector.
Figure 3:
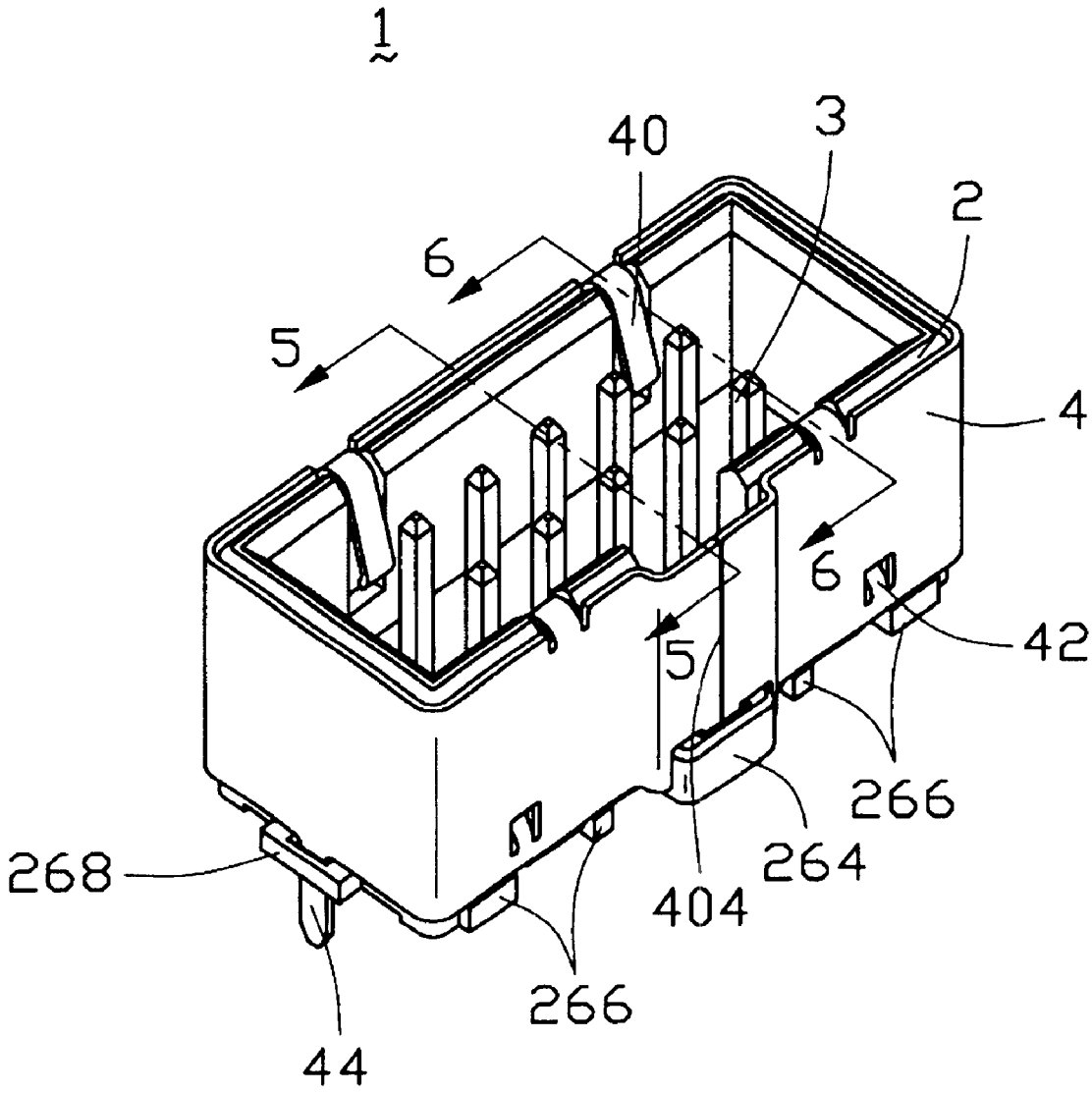
FIG. 3 is an assembled view of the header connector in FIG. 1.
Figure 4:
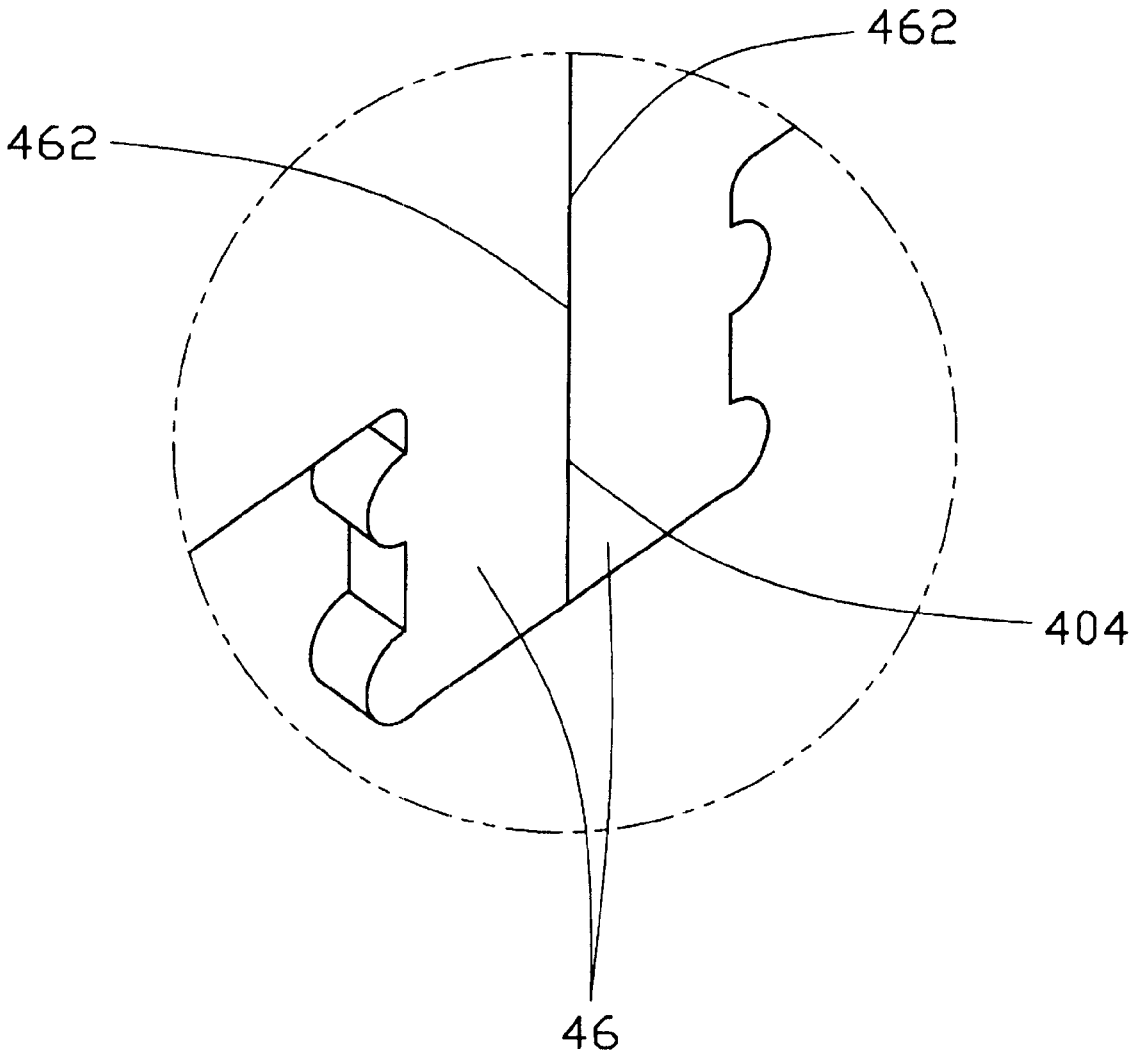
FIG. 4 is an enlarged view of the circled portion in FIG. 1 after the shell is completely assembled to the insulative housing.

Referring to FIGS. 1 and 2 , a header connector 1 in accordance with the present invention comprises an insulative housing 2, a plurality of pin-type terminals 3 retained in the housing 2, and a metal shell 4 enclosing the housing 2 for EMI protection.

Figure 5:
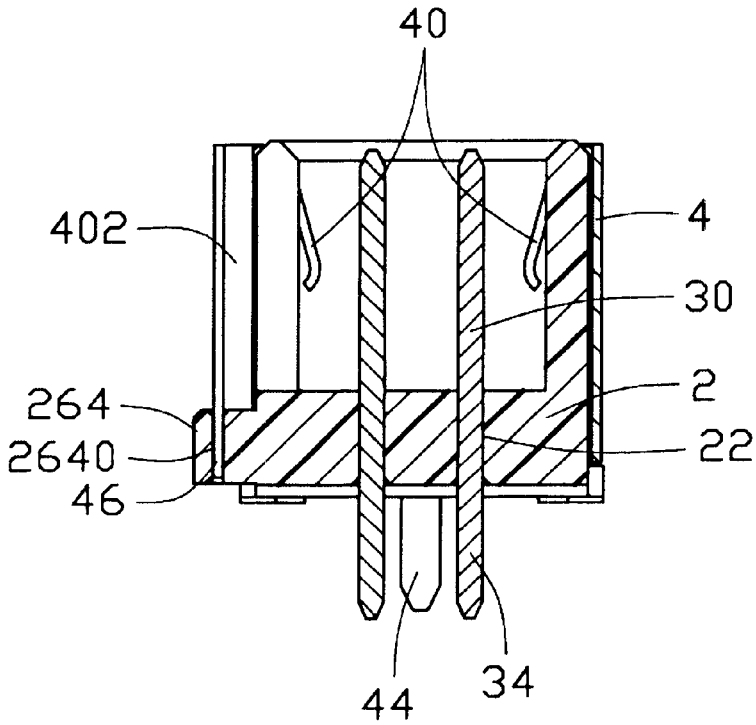
FIG. 5 is a cross-sectional view of the header connector taken along section line 5—5 in FIG. 3.
Figure 6:
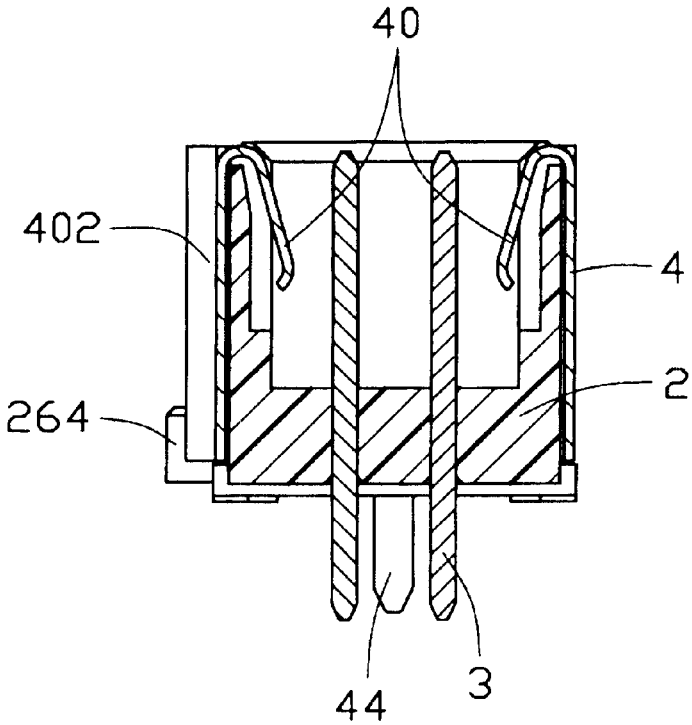
FIG. 6 is a cross-sectional view of the header connector taken along section line 6—6 in FIG. 3.

The housing 2 is generally of a rectangular configuration and defines a receiving cavity 20 through a mating face 200 thereof, and a plurality of passageways 22 (FIG. 5) upwardly extending from a mounting face 202 thereof and communicating with the receiving cavity 20. For polarization and alignment purposes, the housing 2 defines a cutout 24 in a front longitudinal wall 204 and in communication with the receiving cavity 20 for properly engaging with a corresponding projection formed on a complementary cable end connector (not shown).

The housing 2 defines a plurality of recesses 260 on opposite longitudinal sides of the cavity 20, and a plurality of grooves 262 in the front wall 204 and a rear longitudinal wall 206 thereof. A protrusion 264 with an aperture 2640 defined therein forwardly projects from the front wall 204 and below the cutout 24. A plurality of bumps 266 are formed on the front and the rear walls 204, 206 and adjacent to the mounting face 202. A pair of embossments 268 each having a hole 2680 defined therein outwardly extend from opposite transverse side walls 208 of the housing 2. A top face 2682 of each embossment 268 is flush with a top face 2660 of each bump 266.

The pin-type terminals 3 are received in the passageways 22 of the housing 2. Each terminal 3 includes a mating portion 30 disposed in the cavity 20 for engaging with a corresponding terminal of the complementary cable end connector, and a tail portion 34 (FIG. 5) projecting beyond the mounting face 202 for electrically connecting with a printed circuit board (not shown) on which the connector 1 is mounted.

The shell 4 is stamped to be of a single metal blank, with an elongated body portion 400 and a pair of opposite end portions 402 each having a downward extension 46 integrally extending therefrom. The extension 46 has a plurality of barbs 460 formed on an outside face thereof. Each end portion 402 first extends outwardly, or in a direction generally transverse to the longitudinal extent of the body portion 400, and then extends longitudinally relative to the body portion 400. Finally, side edges 462 of the end portions 402 are joined with a seam 404 (as clearly shown in FIG. 2) left therebetween to shape the shell 4 in a rectangular box-like form. The shell 4 is provided with a plurality of spring arms 40 integrally bent therefrom, a plurality of inwardly extending tab members 42 integrally punched therefrom, and a pair of downwardly extending fingers 44 formed at lateral sides thereof.

Referring to FIGS. 3–6, in assembly, the shell 4 is assembled to the housing 2 from the mating face 200 in a vertical direction. The spring arms 40 of the shell 4 are aligned with the recesses 260 of the housing 2 for resiliently engaging with a shell or an insulative housing of the complementary cable end connector. The extensions 46 of the shell 4 are received and retained in the aperture 2640 of the protrusion 264 of the housing 2 by an interferential engagement therebetween, whereby the end portions 402 of the shell 4 are closely abutting each other, i.e., the side edges 462 of the end portions 402 abutting each other with no seam left therebetween. The tab members 42 engage with the grooves 262 of the housing 2 to restrain upward movement of the shell 4. The fingers 44 of the shell 4 are received in the holes 2680 of the embossments 268 of the housing 2 to restrain horizontal movement of the shell 4. In addition, a bottom face 406 of the shell 4 abuts against the bumps 266 and the embossments 268 of the housing 2 to restrain the shell 4 from downward movement. Thus, the shell 4 securely encloses the housing 2 for EMI protection.

When the header connector 1 is mounted on the printed circuit board, the fingers 44 of the shell 4 are received in corresponding through holes of the printed circuit board for positioning and grounding purposes.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A header connector comprising:

an insulative housing having a mating face and a mounting face, the housing defining a receiving cavity through the mating face and an aperture proximate to the mounting face;

a plurality of terminals each mounted to the housing and comprising a mating portion received in the receiving cavity and a tail portion projecting beyond the mounting face of the housing; and a shell enclosing the insulative housing and comprising a body portion and a pair of opposite end portions each including a downwardly extending extension, the extensions being inserted in the aperture and closely abutting each other;

wherein each extension has a plurality of barbs formed thereon for interfering with the aperture;

wherein the housing defines a plurality of recesses in communication with the receiving cavity, and wherein the shell comprises a plurality of spring arms aligned with the recesses and extending downwardly into the receiving cavity;

wherein the housing defines a plurality of outwardly exposed grooves, and wherein the shell comprises a plurality of inwardly extending tab members for engaging with the grooves;

wherein the housing comprises a pair of outwardly extending embossments each having a hole defines therein, and wherein the shell comprises a pair of downwardly extending fingers for being received in the holes;

wherein the housing has a plurality of bumps formed thereon, and wherein the shell has a bottom face abutting against the bumps;

wherein each end portion of the shell first extends outwardly in a direction generally transverse to a longitudinal extend of the body portion and then extends longitudinally relative to the body portion;

wherein the housing defines a cutout in communication with the receiving cavity for properly engaging with a corresponding projection of a complementary connector;

wherein the housing has a protrusion disposed below the cutout, and the aperture is defined in the protrusion.

* * * * *